US008157484B2

(12) United States Patent
Dietrich

(10) Patent No.: US 8,157,484 B2
(45) Date of Patent: Apr. 17, 2012

(54) DEVICE, AND METHOD FOR FEEDING SUBSTANCES

(75) Inventor: Frederic Jun. Dietrich, Morrens (CH)

(73) Assignee: Fydec Holding SA, Ecublens (CH)

( * ) Notice: Subject to any disclaimer, the term of this patent is extended or adjusted under 35 U.S.C. 154(b) by 0 days.

(21) Appl. No.: 12/278,271

(22) PCT Filed: Jan. 30, 2007

(86) PCT No.: PCT/EP2007/000782

§ 371 (c)(1),
(2), (4) Date: Dec. 10, 2008

(87) PCT Pub. No.: WO2007/088022

PCT Pub. Date: Aug. 9, 2007

(65) Prior Publication Data

US 2009/0180899 A1 Jul. 16, 2009

(30) Foreign Application Priority Data

Feb. 2, 2006 (DE) ..... 10 2006 005 190
Feb. 15, 2006 (DE) ..... 10 2006 007 277

(51) Int. Cl.
*B65G 53/60* (2006.01)

(52) U.S. Cl. ..... 406/171; 406/168; 406/109; 406/146

(58) Field of Classification Search ..... 406/12, 406/13, 19, 23, 171, 97, 109, 120, 117, 139, 406/151, 168, 169, 170, 146; 417/182.5, 417/126, 118

See application file for complete search history.

(56) References Cited

U.S. PATENT DOCUMENTS

| | | | | | |
|---|---|---|---|---|---|
| 1,587,864 | A | * | 6/1926 | Sargent | 137/205 |
| 1,816,025 | A | * | 7/1931 | Sablik | 417/125 |
| 3,423,130 | A | * | 1/1969 | Milner | 406/23 |
| 3,556,682 | A | * | 1/1971 | Sakamoto et al. | 417/102 |
| 3,591,316 | A | * | 7/1971 | Piccirilli | 417/364 |
| 3,612,089 | A | * | 10/1971 | Beguiristain | 137/115.02 |
| 3,706,319 | A | * | 12/1972 | Neese et al. | 137/205 |
| 3,736,950 | A | * | 6/1973 | Smallwood | 137/202 |
| 4,057,364 | A | * | 11/1977 | Bratschitsch | 417/34 |
| 4,251,240 | A | * | 2/1981 | Brennan et al. | 96/163 |
| 4,412,762 | A | * | 11/1983 | Lepley et al. | 406/134 |

(Continued)

FOREIGN PATENT DOCUMENTS

EP 0538711 4/1993

(Continued)

*Primary Examiner* — Gene Crawford
*Assistant Examiner* — William R Harp
(74) *Attorney, Agent, or Firm* — Leydig, Voit & Mayer, Ltd.

(57) ABSTRACT

An apparatus for pumping free-flowing materials, having a receptacle coupled to a vacuum pipe and a pumping gas pipe, at least one filter, at least one supply pipe, and at least one drainage pipe for a material being associated with the receptacle. The apparatus includes a vertically extending cylindrical pump chamber configured to pneumatically pump liquids, powder, suspensions and pastes. Further, a device is mounted in an upper region of the pump chamber configured to separate liquid and powder. The device further includes a filter element and a float member. The float member is configured as a sealing element above, and a lower region of the pump chamber is coupled to the at least one supply pipe and the at least one drainage pipe for at least one of a liquid, a powder, a suspension, and a paste.

42 Claims, 3 Drawing Sheets

U.S. PATENT DOCUMENTS

| | | | | |
|---|---|---|---|---|
| 4,530,370 | A * | 7/1985 | Horky | 134/57 R |
| 5,007,803 | A * | 4/1991 | DiVito et al. | 417/137 |
| 5,033,914 | A * | 7/1991 | Wuertele et al. | 406/109 |
| 5,092,743 | A * | 3/1992 | Dietrich | 417/392 |
| 5,265,653 | A | 11/1993 | Herlth | |
| 5,938,408 | A * | 8/1999 | Krichbaum | 417/87 |
| 6,113,663 | A * | 9/2000 | Liu | 55/459.1 |
| 6,264,434 | B1 * | 7/2001 | Frank | 417/130 |
| 6,325,572 | B1 | 12/2001 | Dietrich et al. | |
| 2005/0019107 | A1 * | 1/2005 | Dietrich | 406/122 |

FOREIGN PATENT DOCUMENTS

| | | |
|---|---|---|
| EP | 0937004 | 8/1999 |
| WO | 9817558 | 4/1998 |
| WO | 2004019744 | 3/2004 |

* cited by examiner 58
57
57a
60
55
54
56
36
49
48
38a
37e
52
68
47
50
51
30a
65
e
52
e1
a1
40
44
42
34
54
36
a
46
33
35
38a
49
48
38a
66
d
68
37e
50
65
18
47
52
A
20
62
64
37
32
44
42
40
x
46
35

19

34
21

DEVICE, AND METHOD FOR FEEDING SUBSTANCES

CROSS REFERENCE TO PRIOR RELATED APPLICATIONS

This is a U.S. National Phase application under 35 U.S.C. §371 of International Application No. PCT/EP2007/000782, filed on Jan. 30, 2007, and claims the benefit of German Patent Application No. 10 2006 005 190.4, filed on Feb. 2, 2006 and German Patent Application No. 10 2006 007 277.4, filed on Feb. 15, 2006. The International Application was published in German on Aug. 9, 2007 as WO 2007/088022 A1 under PCT Article 221(2).

The present invention concerns an apparatus for pumping free-flowing materials as well as a method therefor.

BACKGROUND

European Patent Publication No. EP 0 937 004 A describes an apparatus for pneumatically pumping powdered materials having a receptacle which is connected to a supply pipe as well as a discharge for the pumped material and which is separated by at least one plate-like filter element from a chamber connected to a vacuum pipe; the width of the filter element corresponds at the maximum to the diameter of the receptacle. For pumping a material having a specific gravity from 0.1 to 15.0 g/cm$^3$ as well as with a particle size range between 0.1 and 300 μm as the pumped material, the ratio of the length of the pump chamber-forming receptacle for temporarily containing the pumped material to its inside diameter is between 0.5 and 10.0, and the plate-like filter element is provided between a vacuum pipe of a vacuum pump for drawing in the material to be pumped and the pump chamber. Adjoining the chamber connected to the vacuum pump is a pumping gas pipe of a pumping gas source, and both in the vacuum pipe and in the pumping gas pipe is arranged in each case an automatic shut-off member.

EP 0 538 711 A describes a pumping apparatus for example for plastics granulates having a hosepipe which at one end enters a storage silo by means of a lance and at the other end extends through a filter carrier into a pipe connection which is seated on the box-like inlet of a tangential feed opening of a plasticisation cylinder. Above the filter carrier is provided a cover assembly also traversed by the hosepipe and having a suction chamber. The latter has suction openings directed towards the pipe connection and is operatively connected to a nozzle system to which compressed air or compressed gas can be delivered as the working medium. In the suction chamber is generated a relatively high partial pressure which is propagated through the suction openings and the filters into the pipe connection and from there through the hosepipe into the storage silo. This working medium is intended to generate such a high pressure, due to the increase in its speed in the material being pumped, that the solids are drawn to the box-like inlet, while mixing with a suction air stream. At the filters, the solids are separated from the suction air stream and the latter is mixed with the working medium. Filter cleaning cannot be carried out during the process.

According to the state of the art, pumping apparatuses of this kind are tailored to a certain product, that is, to the pumping of powders or the pumping of liquid. Of course some diaphragm pumps may pump powder and liquids, but inefficient treatment of powder is possible only to a minor extent, and only when the powder substance is particularly adapted to the process.

The pumping of suspensions is difficult insofar as the powder in a suspension tends to be deposited in the pipes or closure valves, leading to blockage of the pumping system.

The present invention is directed to an apparatus and a method of the kind mentioned hereinbefore which allow not only the pumping of such different products as liquids, powders and even suspensions or pastes with the same equipment, but also volumetric proportioning thereof.

SUMMARY OF THE INVENTION

The apparatus according to an embodiment of the present invention has in a vertically extending cylindrical pump chamber for pumping liquids, powders, suspensions and pastes in its upper region a device for separating liquid and powder having a filter element and a float member as a sealing element above it, at least one supply pipe and at least one drainage pipe for liquid and/or powder and/or suspension or paste being connected to the pump chamber in its lower region. Several supply pipes for several products are preferred.

BRIEF DESCRIPTION OF THE DRAWINGS

Further advantages, characteristics and details of the present invention are apparent from the description below of preferred embodiments as well as with reference to the drawings; the latter show, in each case in a schematic view.

DETAILED DESCRIPTION

Figure 1:
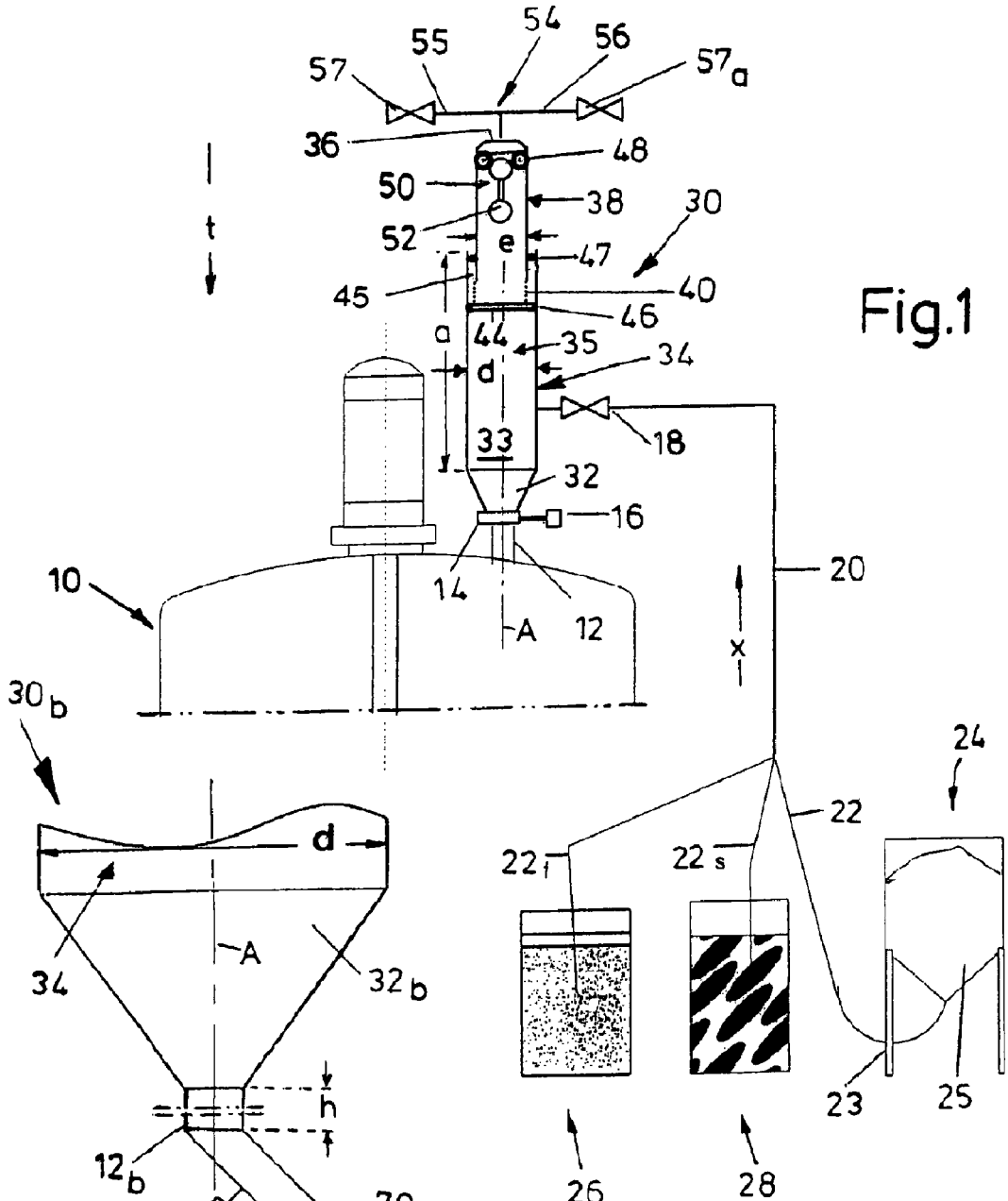
FIG. 1 shows an apparatus mounted on a holding receptacle for free-flowing materials, for pneumatically pumping the materials, in a side view in accordance with an embodiment of the present invention.

According to an aspect of the present invention, the filter element is preferably designed as a filter plate and crosses the longitudinal axis of the device, and is arranged between the device and the pump chamber; the end of the device according to the present invention which is remote from the filter element is associated with the pumping gas pipe and the vacuum pipe. For this purpose a T-shaped connecting pipe with two connecting sections each containing a shut-off valve for the pumping gas pipe and the vacuum pipe is to project from a front wall of the device. On the other hand, the pump chamber is to be connected to at least one inlet valve and to an outlet valve for the material.

In an embodiment according to the present invention, device is designed as an axial apex chamber of the pump chamber of the apparatus and provided in the latter so as to be axially movable and at the same time sealingly encompassed by at least one ring seal of the pump chamber. This ring seal according to an aspect of the present invention is arranged in the cylindrical pump chamber itself or it extends in an annular end collar of which the diameter is shorter than the diameter of the pump chamber.

Further, between end collar and pump chamber is to be integrally formed a ring section which widens in a funnel shape towards the pump chamber and from which preferably a frame for axially guiding the movable apex chamber extends upwards.

It is within the scope of the present invention that the filter element, which as stated is preferably designed as a filter plate, is associated with a base section of the apex chamber of the apparatus which is axially movable in the pump chamber. The filter plate according to an aspect of the present invention is fixed to the perforated base section of the apex chamber and protrudes beyond the latter laterally; for this purpose the filter plate, which is advantageously arranged in a support, is to be encompassed at its edge by at least one sealing bead which on the other side abuts against the inner surface of the pump chamber.

According to an aspect of the present invention, the pump chamber described, at its outlet end is arranged an outlet pipe which is at an angle to its longitudinal axis and which preferably adjoins an axial connecting pipe of the base region of the pump chamber. For the sake of better pumping, on the outlet pipe is to be mounted at least one vibrator. This inclined outlet pipe leads into a pumping pipe, of which the axis is preferably parallel to the pump chamber; also, a closure element is associated with the mouth region and at least one outlet valve is associated with the free end of the pumping pipe. The closure element actuates a closing plate which in the closed position covers the mouth of the outlet pipe. This closing plate is designed so that its position can be selected; by partial closing or opening according to this choice, precise proportioning of the product can be adjusted.

Here, a pump chamber with flat filter is mounted tangentially on a proportioning unit with ventilation facility, and the lateral pump body is connected to vacuum and pressure sources; it contains a tangential inlet with shut-off unit. Laterally on the tapered portion of the pump chamber is mounted a vibration device. At the location at which the pump body leads into the proportioning body is provided a slidable disc which can be opened completely or only up to a selectable gap size in order to allow proportioning.

The proportioning body is connected via a valve to a pressure source, and at the lower end of the proportioning body is provided a shut-off unit. On the other side is located a valve which opens to the atmosphere; ventilation is therefore possible. The pump body can now be filled with product according to the known principle/cycle, and the slidable disc can be opened completely or only partially in order to proportion or to let off product. To allow fine proportioning into the receptacle underneath, the vibration unit can be activated. If the shut-off unit is opened, the product passes into the receptacle underneath, which can be a reactor, drier or the like. The filter of the pump body can be cleaned by a pressure pulse, and this option also exists for the proportioning body. If the contents of the pump body are emptied into the proportioning body, the displaced volume of air escapes via the valve which opens to the atmosphere.

Within the scope of the present invention is an aspect of the present invention in which the device is fixed as an apex frame in the head region of the pump chamber and at a distance from the filter element. This cage-like apex frame consists of rods with substantially parallel axes which if occasion arises are in each case deformed at a distance from their free end in such a way that above a lower base section runs an upper frame section; its diameter is shorter than the diameter of the lower frame section. It proved favourable to let the total length of the apex frame consist approximately two-thirds of its lower frame section and approximately one-third of the upper frame section.

With this apparatus, the filter element is to be mounted as a filter plate in a frame and the latter fixed in the pump chamber between two receptacle sections.

According to another aspect of the present invention, the apex frame is fixed towards the apex in a roof ring and provided at its lower end with a perforated plate or grid, a screen or a filter running approximately parallel to the filter plate. The perforated plate or grid, screen or filter also lies at a distance from the filter plate.

For the sealing function, the float member is advantageously associated with a sealing ring in the apex chamber or in the apex frame; the open centre of the ring can be closed by axially advancing the float member or its ball end or by axially advancing it; sealing ring and float member form a valve composed of two bodies associated with each other, and the open centre of the sealing ring can be covered by a ball end of the float body, that is, the valve closed.

In another embodiment of the apparatus according to the present invention, the float member has at least one ball end with a diameter corresponding to the cross-section of the apex chamber.

In the described embodiments, the float member has two ball ends which are connected by an axial rod as a tubular portion—acting as a dumbbell.

Diameters from 15 to 90 mm, preferably 30 to 70 mm, with the upper ball end sealing off from the vacuum system, proved to be favourable, and the lower ball end has a diameter from 10 to 100 mm, preferably 20 to 80 mm. For this purpose the total length of the apex chamber according to an aspect of the present invention is composed approximately two-thirds of its lower section and approximately one-third of the upper section; the length of the pump chamber is to be preferably between 10 and 1000 mm, preferably 50 and 800 mm or 60 and 100 mm, with a diameter from 5 to 500 mm, preferably 200 mm.

The chamber according to an aspect of the present invention can be made from different materials for pumping aggressive or delicate products, such as special steel, Hastelloy, plastic, glass, enamel, this being with coating.

In an embodiment according to the present invention, the system consists of a calibrated cylindrical chamber having a lateral entrance which is fitted with a shut-off valve or closure valve; a further closure valve is mounted on the bottom outlet side of the apparatus.

On the upper part of the apparatus is installed a system for separating liquid and powder—consisting of a float with a filter. This system can be fixed or movable. A cover closes the whole. It is connected to a pressure source and a vacuum source which are in each case fitted with shut-off valves. The cover includes on the upper portion an O-ring to which the float is applied to close the system when liquid is drawn in.

In an embodiment according to the present invention, the system works—under the control of a switch box—automatically. To pump liquid, the shut-off valve on the vacuum side and the inlet valve are opened; by means of the vacuum, the liquid is drawn in through the inlet pipe connected to the pump chamber. The liquid level rises until the float is lifted and applied to the sealing ring in the filter chamber, in order to interrupt the connection to the vacuum source; due to the vacuum, leaking from the pair consisting of sealing ring and float is prevented. After a certain length of time the inlet valve and the vacuum valve are closed and the pressure valve and the outlet valve are opened. Then the pump chamber is emptied by forcing the liquid out by means of pressure. After a few seconds pressure and outlet valves are closed again and the cycle begins anew.

For pumping powder as well, according to an aspect of the present invention the shut-off valve on the vacuum side and the inlet valve are opened, and by means of the vacuum the powder is drawn in through the pipe system or inlet pipe connected to the pump chamber. The pump chamber fills with powder. The filter in its upper region prevents fine particles from getting into the vacuum system. The float remains in its bottom position, as the speed of the pumping gas is not sufficient to lift it. Here too, after a certain length of time inlet valve and shut-off or vacuum valve are closed, and the pressure valve and outlet valve are opened; the pump chamber is emptied by the pressure which simultaneously cleans the filter in countercurrent, and after a few seconds pressure and outlet valves are closed again. The cycle can begin anew.

If a suspension is to be pumped, the latter is drawn in with partial pressure through the pipe system or inlet pipe connected to the pump chamber, and by means of the filter in the upper portion of the pump chamber the particles of the suspension are separated from the liquid and soiling of the float is prevented. The liquid level rises until the float is lifted and closes the open annular chamber of the sealing ring in order to interrupt the connection to the vacuum source. After a certain waiting time the inlet valve and the vacuum valve are closed, and the pressure valve and outlet valve are opened. The pump chamber is emptied by forcing the powder out by means of pressure which simultaneously cleans the filter in countercurrent. After a few seconds pressure valve and outlet valve are closed again; the cycle can begin again.

This system is further to be used according to the object for the volumetric proportioning of these different products; the system according to the present invention for separating liquid and powder can be displaced in the interior of the pump chamber in order thus to vary its volume.

O-rings inserted in the separation system allow displacement of the system and at the same time enable the system to be sealed off from the pump chamber, the variation in volume of which allows volumetric proportioning. It is of particular importance that the apparatus can be cleaned between the pumping of two different powders by the throughflow of liquid, but above all by drawing in cleaning liquid.

Thus within the scope of the present invention is a method for pneumatically pumping free-flowing materials using the apparatus according an embodiment of the present invention, with which both particulate materials and liquid or suspension or pastes are transferred at the same time from one receptacle to another or a mixture of liquid and particulate materials is pumped or transported, which preferably consists of 0.01 to 99.99% liquid and 99% to 0.01% particulate materials, or 5.0% to 95.0% liquid and 95.0% to 5.0% particulate materials.

Cleaning can also take place by running the apparatus empty.

It also proved favourable to use nitrogen as the emptying gas and to provide an inert atmosphere during the emptying process.

Use of the subject of the present invention is possible both in the pharmaceutical industry and in the chemical industry, paint and lacquer production and in the food industry.

From the apex surface of a reaction vessel or holding receptacle 10 for free-flowing materials, in FIG. 1 a pumping apparatus 30 connected to the latter by a vertical connecting pipe 12 extends upwards. At the junction from the pumping apparatus 30 with the connecting pipe 12, at a shoulder 14 is provided a shut-off member 16 above which the funnel-shaped base region 32 of a cylindrical pump chamber 34 of the pumping apparatus 30 can be seen. From the latter extends, with the interposition of an inlet valve 18, an inlet pipe or supply pipe 20. The latter is connected by its end remote from the pumping apparatus 30 to branch pipes 22, $\mathbf{22}_f$, $\mathbf{22}_s$ which are in each case associated with a storage receptacle 24 for powder or a storage receptacle 26 for liquids or a storage receptacle 28 for a suspension. Depending on control of the apparatus, in each case one of those free-flowing materials flows in the direction of flow x to the pumping apparatus 30.

The powder receptacle 24 resting on a frame 23 is here fitted with a funnel-shaped outlet base 25, the other two storage receptacles 26, 28 are barrel-shaped.

In the interior 35 of the tubular, open-topped pump chamber 34 having a length a of for example 50 to 800 mm and inside diameter d of which the amount is preferably between 10 mm and 500 mm, an apex chamber 38 of narrower outside diameter e provided with a horizontal front wall 36 as a cover is axially inserted in the arrow direction t, forming a narrow cylindrical gap space 45; between the apex chamber 38 and the inner surface 33 of the pump chamber 34 runs a diametrical ring seal 47. Below the latter is shown a perforated base section 40 of the apex chamber 38, the free mouth edge of which is adjoined by a filter or filter plate 44 arranged transversely to the longitudinal axis A of the apparatus. The filter or filter plate 44 is surrounded by a sealing bead 46 which, like the ring seal 47, moves outwards to fit snugly against the inner surface 33 of the pump chamber 34 even during a vertical movement of the apex chamber 38.

Figures 2, 3:
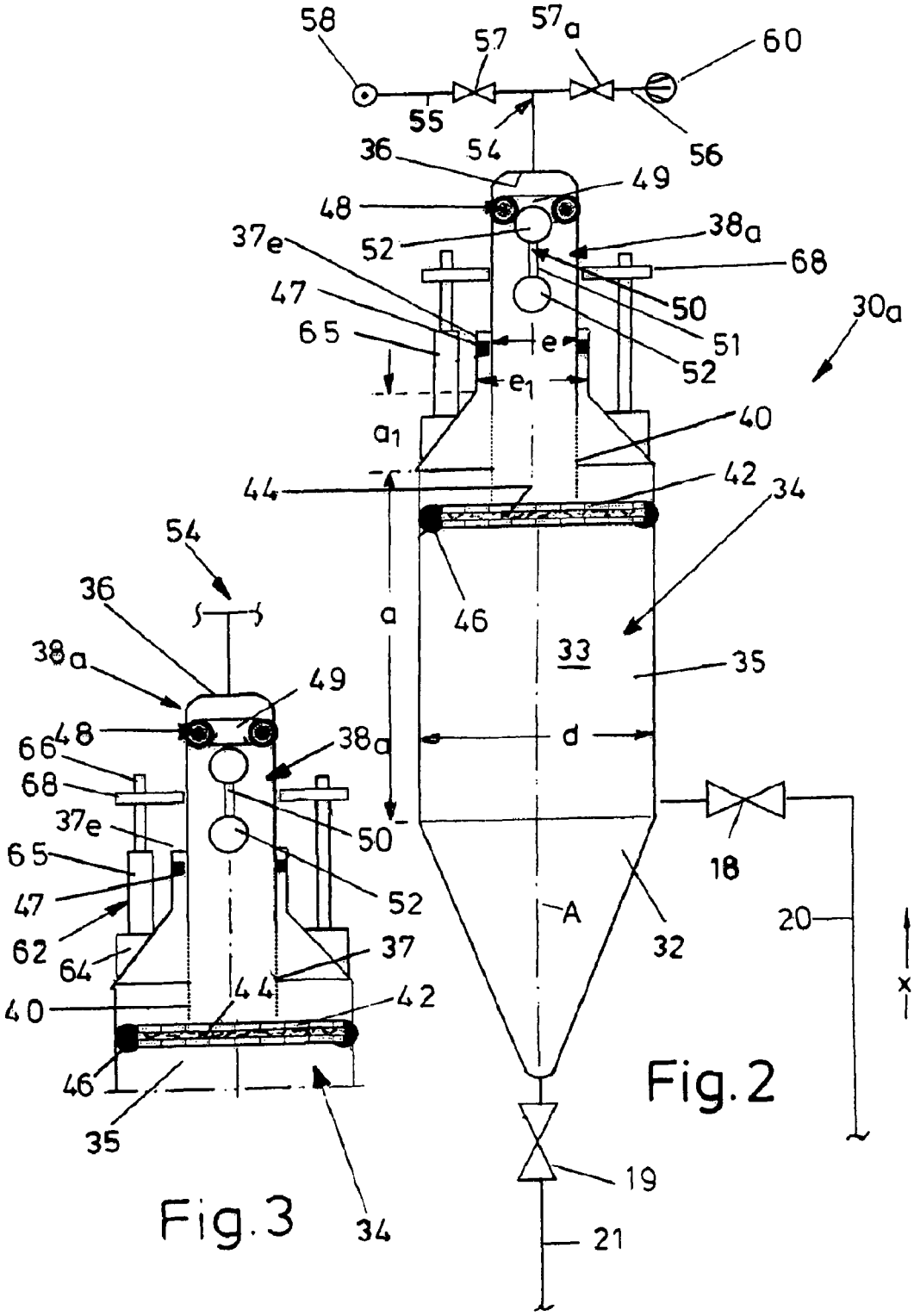
FIG. 2 is an enlarged view of the pumping apparatus of FIG. 1 with details partly altered from the latter in accordance with an embodiment of the present invention.
FIG. 3 is a detailed view of aspects of the pumping apparatus of FIG. 2 with altered setting of some elements in accordance with an embodiment of the present invention.

Near the cover or front wall 36 of the apex chamber 38 can be seen a sealing ring 48 which abuts against its inner surface 33 and with the open ring centre 49 of which is associated a vertically or axially guided float member 50. The cross-section of its ball ends 52, which are connected by a rod 51, is larger than the inside width of the open centre 49 of the sealing ring 48, so that it can be sealed off by a ball end 52 as in FIG. 2. In FIG. 3 is shown the open state of the sealing ring 48, which with the float member 50 forms a kind of valve.

From the front wall 36 of the apex chamber 38 extends upwards a T-shaped connecting pipe 54 for two pipes 55, 56 in each of which is integrated a shut-off valve 57, $\mathbf{57}_a$.

In the pumping apparatus $\mathbf{30}_a$ of FIG. 2, a compressed air or gas source 58 of more than 0.3 bar is associated with the left line 55 of the connecting pipe 54 there as a pumping gas pipe, and a vacuum pump 60 with for example a partial pressure of <500 mbars is associated with the right line 56 that serves as a vacuum pipe.

The cylindrical pump chamber 34 of the pumping apparatus $\mathbf{30}_a$ of FIG. 2 merges at the top with an annular section 37 of length $a_1$ with an inwardly inclined wall surface which is adjoined by a cylindrical end collar $\mathbf{37}_e$ of narrow diameter $e_1$. In this embodiment the ring seal 47 for the apex chamber $\mathbf{38}_a$ sits inside this end collar $\mathbf{37}_e$.

The apex chamber $\mathbf{38}_a$ is here surrounded by a frame 62 of which the base feet 64 are seated on the inclined outer surface of that ring section 37. From the base feet 64, guide profiles 65 or parallel-axis rods 66 extend upwards, with radial stays 68 which guide the axially movable apex chamber $\mathbf{38}_a$; owing to a pneumatic drive, not shown, the apex chamber $\mathbf{38}_a$ can be adjusted in height in the frame 62. The filter plate 44 is here mounted in a mechanical support 42 which is encompassed by the sealing bead 46 described above.

In the embodiment according to FIG. 2, the base region 32 forms a point 31 which is adjoined by a drainage pipe 21 with integrated outlet valve 19.

The system according to an embodiment of the present invention for separating liquid and powder therefore has a float member movable up and down in a guide aid or a float 50 with associated filter 44 in the upper region of the pumping apparatus 30, $\mathbf{30}_a$ which is closed by a cover 36. The latter is connected to at least one pressure source 58 and at least one vacuum source 60. Below the cover 36 or in the upper region of the apex chamber 38, $\mathbf{38}_a$ is provided a sealing ring 48 to which the float 50 is applied in order to close the system when liquid is drawn in the direction of flow x. The automatically operating system is here controlled by a switch box and functions in the following manner:

Pumping of Liquid:

The shut-off valve $\mathbf{57}_a$ on the vacuum side and the inlet valve 18 are opened;

by means of the vacuum the liquid is drawn in through the inlet pipe 20 connected to the pump chamber 34.

The liquid level rises until the float 50 is lifted and applied to the sealing ring 48 in the apex chamber 38, $\mathbf{38}_a$ in order to interrupt the connection to the vacuum source 60. Due to the vacuum, leaking from the pair consisting of sealing ring/float 48/50 is prevented.

After a certain length of time the inlet valve 18 and the vacuum valve $\mathbf{57}_a$ are closed, and the pressure valve 57 and the outlet valve 19 are opened.

The pump chamber 34 is emptied by forcing out the liquid by means of pressure.

After a few seconds pressure valve 57 and outlet valve 19 are closed again and the cycle can begin anew.

Pumping of Powder:

The shut-off valve $\mathbf{57}_a$ on the vacuum side and the inlet valve 18 are opened;

by means of the vacuum the powder is drawn in through the pipe system or inlet pipe 20 connected to the pump chamber 34.

The pump chamber 34 fills with powder, and the filter 44 in its upper region prevents fine particles from getting into the vacuum system. The float 50 remains in its bottom position as in FIG. 3, as the speed of the pumping gas is not sufficient to lift the float 50.

After a certain length of time the inlet valve 18 and the shut-off or vacuum valve $\mathbf{57}_a$ are closed, and the pressure valve 58 and outlet valve 19 are opened.

The pump chamber 34 is emptied by the pressure which at the same time cleans the filter 44 in countercurrent.

After a few seconds pressure valve 57 and outlet valve 19 are closed again and the cycle can begin anew.

Pumping of a Suspension:

The shut-off or vacuum valve $\mathbf{57}_a$ and the inlet valve 18 are opened;

by means of the vacuum the suspension is drawn in through the pipe system or inlet pipe 20 connected to the pump chamber 34.

By the filter 44 on the upper portion of the pump chamber 34, the particles of the suspension are separated from the liquid, and soiling of the float 50 is prevented. The liquid level rises until the float 50 is lifted and closes the open ring chamber 49 of the sealing ring 48 in order to interrupt the connection to the vacuum source 60.

After a certain length of time the inlet valve 18 and the vacuum valve $\mathbf{57}_a$ are closed, and the pressure valve 58 and the outlet valve 19 are opened.

The pump chamber 34 is emptied by forcing out the powder by means of pressure which at the same time cleans the filter 44 in countercurrent.

After a few seconds pressure valve 57 and outlet valve 19 are closed again and the cycle can begin anew.

This system can also be used for the volumetric proportioning of these different products; the system according to the present invention for separating liquid and powder is displaced in the interior 35 of the pump chamber 34 of which the volume varies.

The sealing bead 46 and the ring seal 47 of the separating system allow its displacement, at the same time sealing off from the pump chamber 34 of which the variation in volume allows volumetric proportioning.

Figure 4:
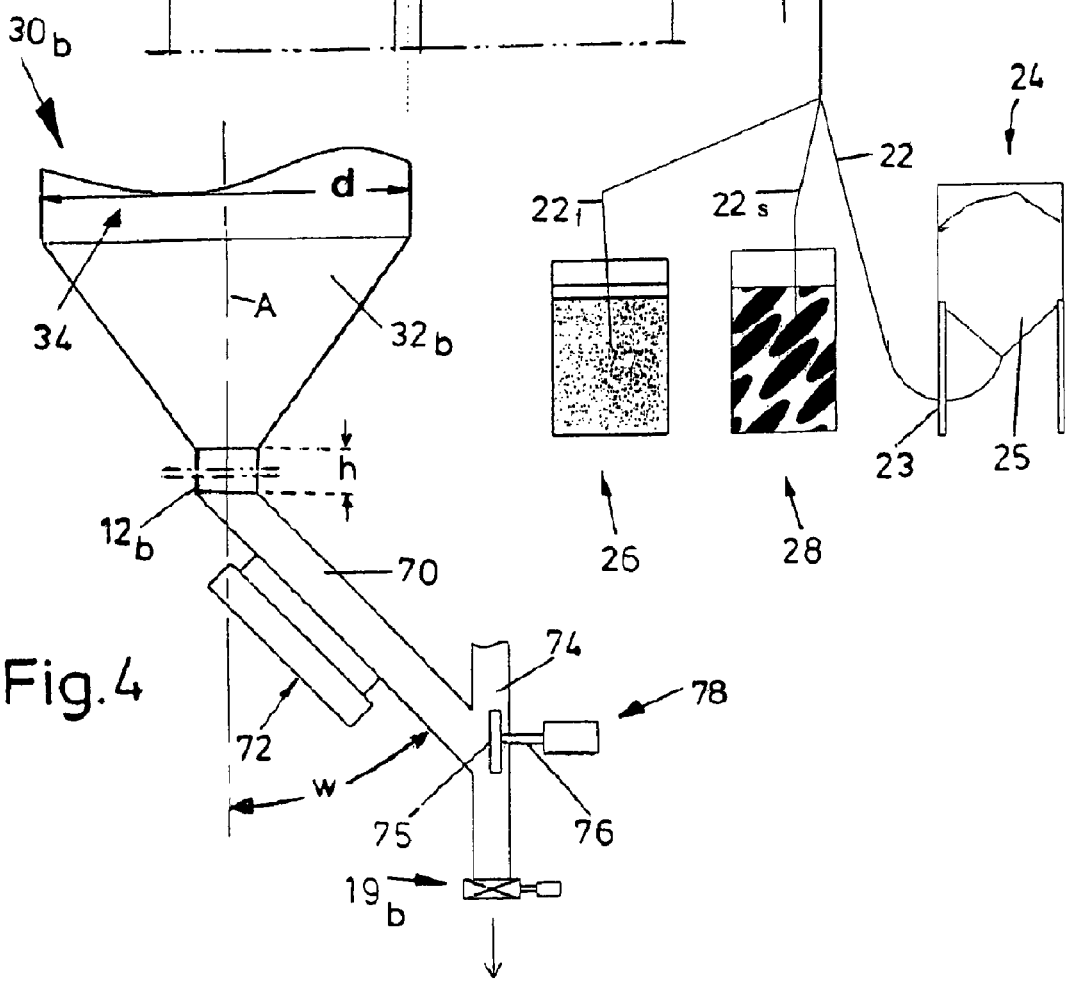
FIG. 4 is a detailed view of aspects of the apparatus from FIGS. 1, 2 in accordance with an embodiment of the present invention.

In the embodiment of the pumping apparatus $\mathbf{30}_b$ of FIG. 4 in accordance with the present invention, its base region $\mathbf{32}_b$ is adjoined by an axial connecting pipe $\mathbf{12}_b$ of any length h which at the other end merges with an outlet pipe 70 inclined at an angle w of for example 45° to the longitudinal axis A of the apparatus; associated with the outlet pipe 70 on the outside is a vibrator 72. This outlet pipe 70 ends at a parallel-axis pumping pipe 74 of which the side wall is traversed by a pressure portion 76 of a closure element 78 carrying a closing plate as a slide 75; the closing plate 75 serves to regulate a pumped stream at the mouth of the outlet pipe 70 and so to proportion the product. Closing of the system described takes place by an outlet valve $\mathbf{19}_b$ which can be seen at the lower end of the pumping pipe 74.

The system according to the present invention or its components can be movable or fixed. For the latter, reference may be made to FIGS. 5, 6, for example; in a bush-like apparatus 80 of FIG. 5 a filter plate $\mathbf{44}_a$ is mounted in a ring-like frame 84 which surrounds the apparatus 80 outside a cylinder wall 82 thereof and which is held by two frame plates 86, $\mathbf{86}_t$. These protrude laterally and so can be fixed by laying them on a support, not shown, for example by means of screws passing through screw holes 87.

On the upper frame plate 86 rests a cylindrical receptacle section 88 which is closed by a dome cover 90 with an apex collar 92 surrounding a central opening 91 of diameter $d_1$. On the latter is seated a roof ring 94 with downwardly and outwardly inclined edge surface 95 which in turn contains a central opening 96 of small diameter $d_2$ in which can be seen a sealing ring 48 and above the latter a supply connection 98 with an interior continuing that opening 96 for connection of the connecting pipe 54 with that of pumping gas pipe 55 and vacuum pipe 56, that is, for overpressure and partial pressure.

In the lower frame plate $\mathbf{86}_t$ is mounted a lower receptacle section $\mathbf{88}_t$ as a cylindrical chamber into the interior $\mathbf{35}_a$ of which lead the supply and drainage pipes 20 and 21 respectively, not visible here; the receptacle sections 88, $\mathbf{88}_t$ yield a cylindrical chamber $\mathbf{34}_a$ with non-movable filter plate $\mathbf{44}_a$ above which extends an axial apex frame 100, also not movable, consisting of in this case four vertically extending rods 102, which is associated with the roof ring 94 on the inside. The diameter $b_1$ of each rod 102 of the apex frame 100 preferably corresponds approximately to the diameter b of the rod 51 of the float 50 of about 10 mm which connects the two ball ends 52.

A perforated plate 110 is joined, near the frame 84 and parallel thereto, to the free ends 104 of the rods 102 which determine an inside diameter f of a base section 105 of length g of the apex frame. At that distance g from its lower rod end 104 or the perforated plate 110, the rod 102 is inclined towards the axis at an angle $w_1$ of about 30° over a short length $g_1$ as a rod section 106, so that the inside diameter $f_1$ of the upper frame section 108 following above and having an axial length $g_2$ is shorter than the above-mentioned diameter f. The length $g_2$ is here moreover shorter than half the length g of the base section 104. An equally short length $g_3$ is provided by the end sections 107 of the rods 102 which are inclined outwards in the opposite direction to those rod sections 106 and are arranged on the inside of the roof ring 94.

Figures 5, 6:
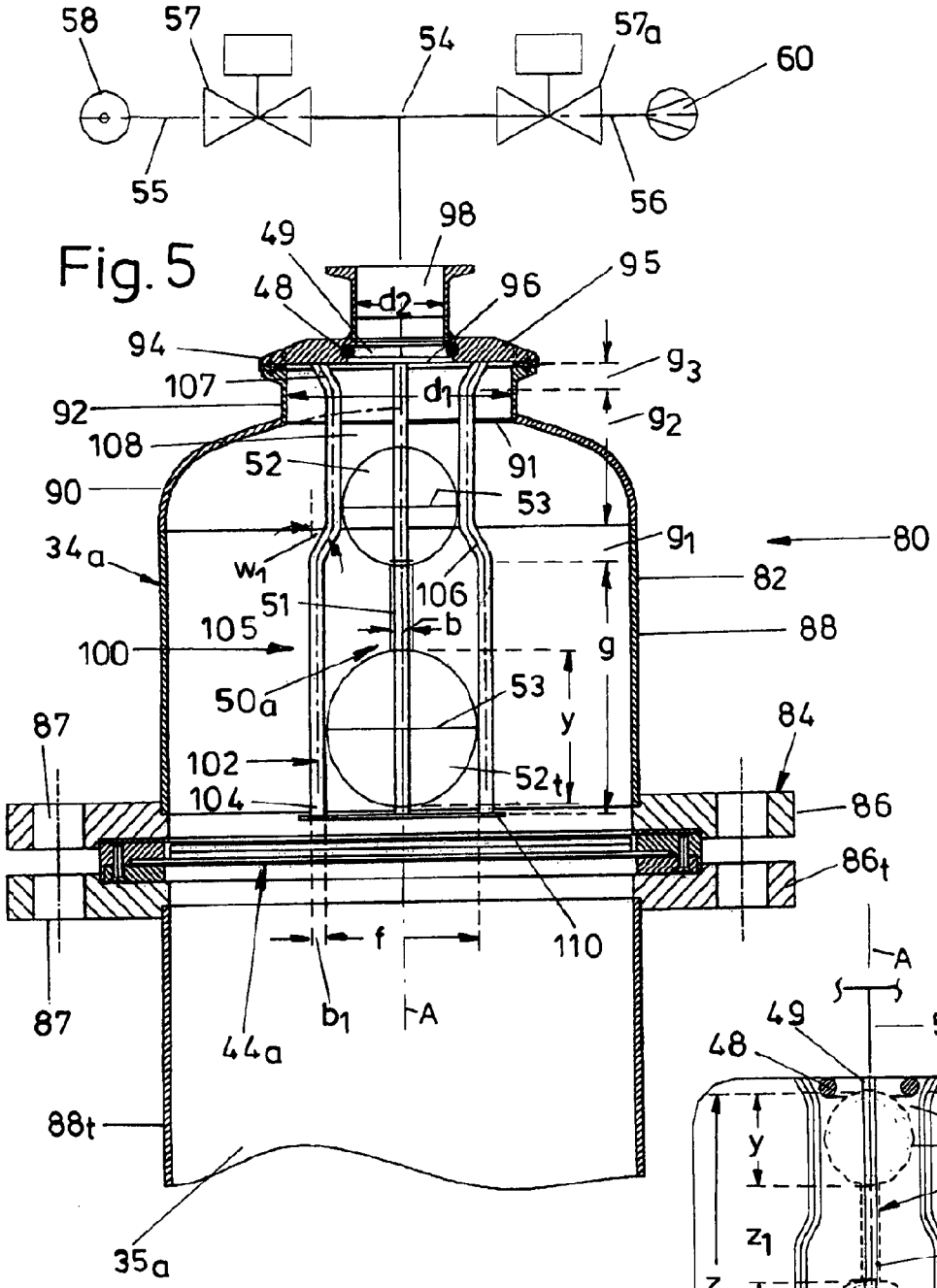
FIG. 5 is a side view of a pumping apparatus in accordance with another embodiment of the present invention.
FIG. 6 is a drawing of a variant of the pumping apparatus of FIG. 5 in a side view in accordance with an embodiment of the present invention.

The pump chamber $\mathbf{34}_b$ of FIG. 6 differs from the pump chamber $\mathbf{34}_a$ of FIG. 5 above all by a flat apex cover 89 with which the sealing ring 48 is associated on the inside; the latter lies between the inclined end sections 107 of the apex frame 100.

In the apex frame 100 of FIGS. 5, 6 is located a float member or float $\mathbf{50}_a$ with for example a length z of 150 mm, with ball ends 52, $\mathbf{52}_t$ of different diameter y, $y_1$ of 50 and 65 mm respectively provided at both ends of the rod 51 with a length $z_1$ of here 35 mm.

The ball ends 52 and $\mathbf{52}_t$ of which the wall thickness is for example 0.6 mm lie loosely in the apex frame 100, but can in the region of their respective equator 53 if occasion arises abut against the rods 102 in the base section 105 or in the upper frame section 108 on the inside, so that the float $\mathbf{50}_a$ is guided axially. During the closing operation, as already stated above and shown in FIG. 6, the upper ball end 52 is applied to the sealing ring 48 and so closes the open centre 49 of the ring. In the opposite direction the perforated plate or perforated grate 110 limits the path of drop of the float 50, $\mathbf{50}_a$.

The present invention is not limited to embodiments described herein; reference should be had to the appended claims. Moreover, with given ranges of terms, values within the limits mentioned are also intended to be disclosed as limit values and capable of being used as desired.

The invention claimed is:

1. An apparatus for pumping free-flowing materials, comprising:

a vacuum pipe connected to a vacuum pump;

a pumping gas pipe connected to a pumping gas source;

a receptacle coupled to the vacuum pipe and the pumping gas pipe;

at least one supply pipe;

at least one drainage pipe for a material being associated with the receptacle;

a vertically extending cylindrical pump chamber with a base region and defining a longitudinal axis, the vacuum pump and the pumping gas source configured to pneumatically pump a liquid, a powder, a suspension and a paste into the pump chamber;

a device mounted in an upper region of the pump chamber configured to separate liquid and powder, the device having a float member configured as a sealing element, wherein a lower region of the pump chamber is coupled to the at least one supply pipe for supplying at least one of the liquid, the powder, the suspension, and the paste to the pump chamber and wherein the float member has a first ball end and a second ball end, the first ball end and the second ball end being axially coupled by a tubular portion, and wherein the device forms an axial apex chamber of the pump chamber and is disposed so as to be axially movable; and a filter element disposed between the device and the base region of the pump chamber.

2. The apparatus as recited in claim 1, wherein the at least one supply pipe includes a plurality of supply pipes, each pipe configured for at least one of a plurality of the liquid, the powder, the suspension, and the paste.

3. The apparatus as recited in claim 1, wherein the device defines a longitudinal axis extending vertically into the lower region of the pump chamber, and wherein the filter element is disposed at a lower part of the device and intersects the longitudinal axis.

4. The apparatus as recited in claim 1, wherein an end of the device opposite the filter element is associated to the pumping gas pipe and the vacuum pipe.

5. The apparatus as recited in claim 4, further comprising a T-shaped connecting pipe extending from a front wall of the device and having a first connection section and a second connection section, each connection section including a shut-off valve for one of the pumping gas pipe and the vacuum pipe.

6. The apparatus as recited in claim 1, further comprising at least one inlet valve and at least one outlet valve for the material coupled the pump chamber.

7. The apparatus as recited in claim 1, wherein the pump chamber includes at least one ring seal sealingly encompassing the apex chamber.

8. The apparatus as recited in claim 7, wherein the ring seal is disposed in the pump chamber so as to form an annular gap with the apex chamber.

9. The apparatus as recited in claim 7, wherein the ring seal is disposed in an annular end collar having a first diameter that is smaller than a second diameter of the pump chamber.

10. The apparatus as recited in claim 9, further comprising a ring section integrally disposed between the end collar and the pump chamber, the ring section widening into a funnel shape to the pump chamber.

11. The apparatus as recited in claim 10, further comprising a frame configured to axially guide the movable apex chamber upwards from the ring section.

12. The apparatus as recited in claim 7, wherein the float member is coupled to a sealing ring in the apex chamber or in an apex frame, and an open centre of the ring can be closed by the float member.

13. The apparatus as recited in claim 12, wherein the sealing ring forms a first body of a valve, and the float member forms a second body of the valve, the open centre of the sealing ring being closable by a ball end of the second body.

14. The apparatus as recited in claim 12, wherein the float member has at least one ball end, the at least one ball end able to close an entrance to the vacuum pipe.

15. The apparatus as recited in claim 12, the float member having an upper ball end and a lower ball end, the upper ball end able to seal off from the vacuum system, the upper ball end having a diameter within the range of 15 mm to 90 mm, and the lower ball end having a diameter within the range of 10 mm to 100 mm.

16. The apparatus as recited in claim 1, wherein the filter element includes a filter plate coupled to a base section of the apex chamber of the apparatus.

17. The apparatus as recited in claim 16, wherein the base section of the apex chamber is perforated.

18. The apparatus as recited in claim 17, further comprising at least one sealing bead abutting against an inner surface of the pump chamber and encompassing the filter plate at an edge of the filter plate.

19. The apparatus as recited in claim 16, wherein the filter plate is coupled to the base section of the apex chamber and extends beyond the base section in a lateral direction.

20. The apparatus as recited in claim 1, further comprising an outlet pipe coupled to an outlet end of the pump chamber and an axial connecting pipe at a base region of the pump chamber, the outlet pipe being disposed at an acute angle to the longitudinal axis.

21. The apparatus as recited in claim 20, further comprising at least one vibrator mounted on the outlet pipe.

22. The apparatus as recited in claim 20, further comprising a pumping pipe having an axis parallel to the pump chamber, a closure element associated with a mouth region of the outlet pipe, and at least one outlet valve associated with a free end of the pumping pipe, wherein the inclined outlet pipe is coupled to the pumping pipe.

23. The apparatus as recited in claim 22, wherein the closure element includes a closing plate, and wherein the mouth region of the outlet pipe is configured to be at least partially covered by the closing plate.

24. The apparatus as recited in claim 1, wherein the device is configured as an apex frame in a head region of the pump chamber and at a distance from the filter element.

25. An apparatus for pumping free-flowing materials, comprising:

a vacuum pipe connected to a vacuum pump;

a pumping gas pipe connected to a pumping gas source;

a receptacle coupled to the vacuum pipe and the pumping gas pipe;

at least one supply pipe;

at least one drainage pipe for a material being associated with the receptacle;

a vertically extending cylindrical pump chamber with a base region and defining a longitudinal axis, the vacuum pump and the pumping gas source configured to pneumatically pump a liquid, a powder, a suspension and a paste into the pump chamber;

a device mounted in an upper region of the pump chamber configured to separate liquid and powder, the device having a float member configured as a sealing element, wherein a lower region of the pump chamber is coupled to the at least one supply pipe for supplying at least one of the liquid, the powder, the suspension, and the paste to the pump chamber and wherein the float member has a first ball end and a second ball end, the first ball end and the second ball end being axially coupled by a tubular portion, wherein the device is configured as an apex frame in a head region of the pump chamber and at a distance from the filter element, wherein the apex frame has an upper frame section and a lower frame section, is cage-like and comprises substantially parallel deformable rods; and a filter element disposed between the device and the base region of the pump chamber.

26. An apparatus for pumping free-flowing materials, comprising:

a vacuum pipe connected to a vacuum pump;

a pumping gas pipe connected to a pumping gas source, a receptacle coupled to the vacuum pipe and the pumping gas pipe;

at least one supply pipe;

at least one drainage pipe for a material being associated with the receptacle;

a vertically extending cylindrical pump chamber with a base region and defining a longitudinal axis, the vacuum pump and the pumping gas source configured to pneumatically pump a liquid, a powder, a suspension and a paste into the pump chamber;

a device mounted in an upper region of the pump chamber configured to separate liquid and powder, the device having a float member configured as a sealing element, wherein a lower region of the pump chamber is coupled to the at least one supply pipe for supplying at least one of the liquid, the powder, the suspension, and the paste to the pump chamber and wherein the float member has a first ball end and a second ball end, the first ball end and the second ball end being axially coupled by a tubular portion, wherein the device is configured as an apex frame in a head region of the pump chamber and at a distance from the filter element, the apex frame comprising a lower frame section comprising approximately two-thirds of a total length of the apex frame, and an upper frame section comprising approximately one-third of the total length of the apex frame; and a filter element disposed between the device and the base region of the pump chamber.

27. The apparatus as recited in claim 26, further comprising a perforated plate or grid, a screen or filter, and a roof ring, the apex frame being fixed towards an apex in the roof ring, and the perforated plate or grid being disposed at a lower end of the apex frame, and the screen or filter being substantially parallel to the filter plate.

28. The apparatus as recited in claim 27, wherein the perforated plate or grid, the screen or filter is disposed at a distance from the filter plate and is substantially parallel to the filter plate.

29. The apparatus as recited in claim 26, wherein the filter element comprises a filter plate disposed in a filter frame, the filter frame being fixed in the pump chamber, disposed between a first receptacle section and a second receptacle section.

30. An apparatus for pumping free-flowing materials, comprising:

a vacuum pipe connected to a vacuum pump;

a pumping gas pipe connected to a pumping gas source;

a receptacle coupled to the vacuum pipe and the pumping gas pipe;

at least one supply pipe;

at least one drainage pipe for a material being associated with the receptacle;

a vertically extending cylindrical pump chamber with a base region and defining a longitudinal axis, the vacuum pump and the pumping gas source configured to pneumatically pump a liquid, a powder, a suspension and a paste into the pump chamber;

a device mounted in an upper region of the pump chamber configured to separate liquid and powder, the device having a float member configured as a sealing element, wherein a lower region of the pump chamber is coupled to the at least one supply pipe for supplying at least one of the liquid, the powder, the suspension, and the paste to the pump chamber and wherein the float member has a first ball end and a second ball end, the first ball end and the second ball end being axially coupled by a tubular portion, wherein the device is configured as an apex frame in a head region of the pump chamber and at a distance from the filter element wherein the first ball end has a first diameter and the second ball end has a second diameter, the first and second diameters each being associated with a first section and a second section of the apex frame, respectively, the first and second sections having corresponding inside widths; and a filter element disposed between the device and the base region of the pump chamber.

31. The apparatus as recited in claim 30, wherein the first ball end and the second ball end are equatorially associated with the first and second sections of corresponding inside widths of the apex frame.

32. The apparatus as recited in claim 1, wherein the pump chamber has a length from within the range of 10 mm to 1000 mm.

33. The apparatus as recited in claim 1, wherein the pump chamber has a diameter within the range of 5 mm to 500 mm.

34. The apparatus as recited in claim 1, wherein the pumping gas source is configured to supply a pressure of more than 0.3 bar and the vacuum pump is configured to create a vacuum of less than 500 mbar.

35. A method for pneumatically pumping free-flowing materials using comprising:

providing an apparatus having a vacuum pipe connected to a vacuum pump; a pumping gas pipe connected to a pumping gas source; a receptacle coupled to the vacuum pipe and the pumping gas pipe; at least one supply pipe; at least one drainage pipe for a material being associated with the receptacle; a vertically extending cylindrical pump chamber having a base region and defining a longitudinal axis, wherein an apex chamber is axially displaced in the pump chamber, the vacuum pump and the pumping gas source configured to pneumatically pump a liquid, a powder, a suspension and a paste into the pump chamber; a device mounted in an upper region of the pump chamber configured to separate liquid and powder and having a float member configured as a sealing element, wherein a lower region of the pump chamber is coupled to the at least one supply pipe and the at least one drainage pipe for at least one of the liquid, the powder, the suspension, and the paste; and wherein the float member has a first ball end and a second ball end, the first ball end and the second ball end being axially coupled by a tubular portion, and a filter element disposed between the device and the base region of the pump chamber; and transferring particulate materials and liquid or suspension or pastes at a same time from a first receptacle to a second receptacle using the apparatus.

36. The method as recited in claim 35, wherein a mixture of liquid and particulate materials is pumped or transported.

37. The method as recited in claim 35, further comprising proportioning the material by selecting utilizing a partial opening of a closure element at an outlet pipe.

38. The method as recited in claim 35, wherein a mixture of 0.01 to 99.99% liquid and 99% to 0.01% particulate materials is pumped or transported.

39. The method as recited in claim 35, further comprising drawing in a cleaning liquid so as to clean the apparatus.

40. The method as recited in claim 35, further comprising running the apparatus empty so as to clean the filter element.

41. The method as recited in claim 40, wherein running of the apparatus empty includes introducing nitrogen as an emptying gas and providing an inert atmosphere.

42. The method as recited in claim 35, wherein the pumping gas source is configured to supply a pressure of more than 0.3 bar and the vacuum pump is configured to create a vacuum of less than 500 mbar.

* * * * *